US008469089B2

(12) United States Patent
Maier et al.

(10) Patent No.: US 8,469,089 B2
(45) Date of Patent: Jun. 25, 2013

(54) PROCESS AND APPARATUS TO IMPROVE RELIABILITY OF PINPOINT STIMULATION OPERATIONS

(75) Inventors: Gary A. Maier, Calgary (CA); Jim B. Surjaatmadja, Duncan, OK (US); Fraser McNeil, Houston, TX (US); Keith A. Rispler, Red Deer (CA)

(73) Assignee: Halliburton Energy Services, Inc., Houston, TX (US)

( * ) Notice: Subject to any disclaimer, the term of this patent is extended or adjusted under 35 U.S.C. 154(b) by 84 days.

(21) Appl. No.: 12/651,828

(22) Filed: Jan. 4, 2010

(65) Prior Publication Data

US 2011/0162843 A1 Jul. 7, 2011

(51) Int. Cl.
*E21B 21/00* (2006.01)

(52) U.S. Cl.
USPC ..... 166/223; 166/308.1; 166/298; 166/307; 166/297; 166/325; 137/493.1; 137/493.9

(58) Field of Classification Search
USPC ..... 166/223, 308.1, 298, 307, 297, 325; 137/493.1, 493.9
See application file for complete search history.

(56) References Cited

U.S. PATENT DOCUMENTS

| | | | | |
|---|---|---|---|---|
| 2,753,940 | A * | 7/1956 | Bonner | 166/308.1 |
| 5,105,890 | A * | 4/1992 | Duguid et al. | 166/380 |
| 5,271,461 | A | 12/1993 | Decker et al. | |
| 5,765,642 | A | 6/1998 | Surjaatmadja | |
| 6,394,184 | B2 | 5/2002 | Tolman et al. | |
| 6,543,538 | B2 | 4/2003 | Tolman et al. | |
| 6,776,239 | B2 * | 8/2004 | Eslinger et al. | 166/308.1 |
| 7,225,869 | B2 | 6/2007 | Willett et al. | |
| 7,343,975 | B2 | 3/2008 | Surjaatmadja et al. | |
| 2002/0108755 | A1 | 8/2002 | Edward | 166/369 |
| 2003/0192694 | A1 | 10/2003 | James et al. | 166/278 |
| 2005/0121196 | A1 | 6/2005 | East, Jr. et al. | |
| 2005/0133226 | A1 | 6/2005 | Lehman | |
| 2005/0241824 | A1 | 11/2005 | Burris, II et al. | |
| 2006/0070740 | A1 * | 4/2006 | Surjaatmadja et al. | 166/308.1 |
| 2006/0196667 | A1 * | 9/2006 | Alba et al. | 166/308.1 |
| 2007/0051517 | A1 | 3/2007 | Surjaatmadja et al. | 166/308.1 |
| 2008/0202748 | A1 * | 8/2008 | Bussear et al. | 166/264 |
| 2010/0126725 | A1 * | 5/2010 | Ravensbergen | 166/297 |
| 2010/0294503 | A1 * | 11/2010 | Laurel et al. | 166/335 |

FOREIGN PATENT DOCUMENTS

WO WO 2006/016137 2/2006

OTHER PUBLICATIONS

East et al., "Successful Applications of Hydrajet Fracturing on Horizontal Wells Completed in a Thick Shale Reservoir," presented at the 2004 SPE Eastern Regional Meeting held in Charleston, West Virginia, Sep. 15-17, 2004, SPE 91435.

East, et al., "Packerless Multistage Fracture-Stimulation Method Using CT Perforating and Annular Path Pumping," presented at the 2005 SPE Annual Technical Conference and Exhibition held in Dallas, Texas, Oct. 9-12, 2005, SPE 96732.

(Continued)

*Primary Examiner* — Yong-Suk (Philip) Ro
(74) *Attorney, Agent, or Firm* — Robert A. Kent; McDermott Will & Emery LLP

(57) ABSTRACT

An anchor tool having a housing, a one-way restrictor device in fluid communication with the housing, and a stabilizer affixed to the housing. The one-way restrictor device is configured to allow restricted flow in a first direction, and to allow flow in a second direction.

19 Claims, 4 Drawing Sheets

OTHER PUBLICATIONS

Gilbert et al., "Applications of Pinpoint Fracturing in the Cooper Basin, Australia," presented at the 2005 SPE Annual Technical Conference and Exhibition held in Dallas, Texas, Oct. 9-12, 2005, SPE 97004.

Fussell et al., "Application of Coiled-Tubing Fracturing Method Improves Field Production," presented at the 2006 SPE/ ICoTA Coiled Tubing and Well Intervention Conference and Exhibition held in The Woodlands, Texas, Apr. 4-5, 2006, SPE 100143.

Hejl et al., "Extreme Multistage Fracturing Improves Vertical Coverage and Well Performance in the Lost Hills Field," presented at the 2006 SPE Annual Technical Conference and Exhibition held in San Antonio, Texas, Sep. 24-27, 2006, SPE 101840.

Beatty et al., "Pin-Point Fracturing (PPF) in Challenging Formations," presented at the 2007 SPE Hydraulic Fracturing Technology Conference held in College Station, Texas, Jan. 29-31, 2007, SPE 106052.

Peak et al., "Coiled-Tubing-Deployed Fracturing Service Yields Increase in Completion Efficiency," presented at the 2007 SPE/ ICoTA Coiled Tubing and Well Intervention Conference and Exhibition held in The Woodlands, Texas, Mar. 20-21, 2007, SPE 107060.

Romer et al., "Well-Stimulation Technology Progression in Horizontal Frontier Wells, Tip Top/Hogsback Field, Wyoming," presented at the 2007 SPE Annual Technical Conference and Exhibition held in Anaheim, California, Nov. 11-14, 2007, SPE 110037.

Hejl et al., "Extreme Multistage Fracturing Improves Vertical Coverage and Well Performance in the Lost Hills Field," originally published as SPE 101840 and revised for publication in Dec. 2007 SPE Drilling & Completion.

Maddox et al., "Cementless Multi-Zone Horizontal Completion Yields Three-Fold Increase," presented at the 2008 IADC/SPE Drilling Conference held in Orlando, Florida, Mar. 4-6, 2008, IADC/SPE 112774.

East et al., "Hydrajet Perforating and Proppant Plug Diversion in Multi-Interval Horizontal Wall Fracture Stimulation: Case Histories," presented at the 2008 SPE Tight Gas Completions Conference held in San Antonio, Texas, Jun. 9-11, 2008, SPE 114881.

International Search Report and Written Opinion for PCT/GB2010/000849 dated Feb. 9, 2011.

International Search Report in PCT/GB2009/000375, Aug. 17, 2010.

Office Action Issued in U.S. Appl. No. 12/244,547, Sep. 14, 2010.

International Preliminary Report on Patentability for PCT/GB2010/000849 dated Jul. 4, 2012.

* cited by examiner

PROCESS AND APPARATUS TO IMPROVE RELIABILITY OF PINPOINT STIMULATION OPERATIONS

BACKGROUND

The present invention relates to subterranean stimulation operations and, more particularly, to processes and apparatus for improving the reliability of pinpoint stimulation operations.

To produce hydrocarbons (e.g., oil, gas, etc.) from a subterranean formation, well bores may be drilled that penetrate hydrocarbon-containing portions of the subterranean formation. The portion of the subterranean formation from which hydrocarbons may be produced is commonly referred to as a "production zone." In some instances, a subterranean formation penetrated by the well bore may have multiple production zones at various locations along the well bore.

Generally, after a well bore has been drilled to a desired depth, completion operations are performed. Such completion operations may include inserting a liner or casing into the well bore and, at times, cementing a casing or liner into place. Once the well bore is completed as desired (lined, cased, open hole, or any other known completion) a stimulation operation may be performed to enhance hydrocarbon production into the well bore. Where methods of the present invention reference "stimulation," that term refers to any stimulation technique known in the art for increasing production of desirable fluids from a subterranean formation adjacent to a portion of a well bore. Examples of some common stimulation operations involve hydraulic fracturing, acidizing, fracture acidizing, and hydrajetting. Stimulation operations are intended to increase the flow of hydrocarbons from the subterranean formation surrounding the well bore into the well bore itself so that the hydrocarbons may then be produced up to the wellhead.

Conventional pinpoint stimulation techniques may be susceptible to movements of the hydrajetting tool, which can generally reduce the tool performance. These movements may be caused by a number of factors, including wellbore geometry and tubing movement due to thermal and pressure effects. Further movement may occur around the hydrajetting tool due to the effects of turbulence, vibration, pressure related piston effects and jet thrust. Longer jetting times may compensate for this reduction in tool performance. However, the increase in jetting times may not be desirable.

One suitable hydrajet stimulation method, introduced by Halliburton Energy Services, Inc., is known as the SURGIFRAC and is described in U.S. Pat. No. 5,765,642. The SURGIFRAC process may be particularly well suited for use along highly deviated portions of a well bore, where casing the well bore may be difficult and/or expensive. The SURGIFRAC hydrajetting technique makes possible the generation of one or more independent, single plane hydraulic fractures. Furthermore, even when highly deviated or horizontal wells are cased, hydrajetting the perforations and fractures in such wells generally result in a more effective fracturing method than using traditional perforation and fracturing techniques.

During the SURGIFRAC process, which uses the Bernoulli principle to achieve fluid diversion between fractures, the primary flow goes to the fracture while the secondary, leakoff flow, is supplied by the annulus. In some instances, such as in long horizontal well bores, a large number of fractures may be desired. The formation of each fracture results in some additional leakoff. Consequently, with the increase in the number of fractures, the amount of the secondary, leakoff flow increases and eventually may exceed the amount of the primary flow to the fracture. The increased fluid loss may reduce the efficiency of the operations and increases the cost.

Another suitable hydrajet stimulation method, introduced by Halliburton Energy Services, Inc., is known as the COBRAMAX and is described in U.S. Pat. No. 7,225,869, and is applicable to vertical, deviated, and horizontal wells, which is incorporated herein by reference in its entirety. The COBRAMAX process may be particularly well suited for use along highly deviated portions of a well bore. The COBRAMAX technique makes possible the generation of one or more independent hydraulic fractures without the necessity of zone isolation, can be used to perforate and fracture in a single down hole trip, and may eliminate the need to set mechanical plugs through the use of a sand plug.

The COBRAMAX process involves isolating the hydrajet stimulated zones from subsequent well operations. The primary fluid diversion of the previous regions in the COBRAMAX process is achieved by placing sand plugs in the zones to be isolated. The placement of sand plugs, particularly in horizontal well bores, may require a prescribed flow rate, which may be difficult to achieve when using surface pumping equipment.

Other methods for improving reliability of pinpoint stimulation operations are described in U.S. patent application Ser. No. 12/244,547 filed on Oct. 2, 2008, which is hereby incorporated by reference as if fully reproduced herein.

SUMMARY

The present invention relates to subterranean stimulation operations and, more particularly, to processes and apparatus for improving the reliability of pinpoint stimulation operations.

In some embodiments, an anchor tool comprises a housing, a one-way restrictor device in fluid communication with the housing, and a stabilizer affixed to the housing. The one-way restrictor device may be configured to allow restricted flow in a first direction, and to allow flow in a second direction.

In other embodiments, a method of diverting flow may comprise pumping fluid through a stimulation tool, passing at least a portion of the fluid from the stimulation tool through an anchor tool, introducing the fluid from the anchor tool at a desired location, and diverting flow at the desired location. Passing the fluid through the anchor tool may comprise passing the fluid through a one-way restrictor device.

In yet other embodiments, a method of improving the performance of a stimulation tool may comprise stabilizing an anchor tool connected to the stimulation tool, introducing a fluid into the stimulation tool, passing a first portion of the fluid out of the stimulation tool and into a formation, and passing a second fluid of the fluid through the stimulation tool to the anchor tool.

In still other embodiments, a hydrajetting bottomhole assembly may comprise a hydrajetting tool, and a hydrajet anchor tool connected to the hydrajetting tool. The hydrajet anchor tool may comprise a housing, a one-way restrictor device in fluid communication with the housing, and a stabilizer affixed to the housing. The one-way restrictor device may be configured to allow restricted flow in a first direction, and to allow flow in a second direction.

Various features and advantages of the present invention will be apparent to those skilled in the art from the description of the preferred embodiments which follows when taken in conjunction with the accompanying drawings. While those skilled in the art may make numerous changes, such changes are within the spirit of the invention.

BRIEF DESCRIPTION OF THE DRAWINGS

The following drawings illustrate certain aspects of some embodiments of the present invention, and should not be used to limit or define the invention.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates to subterranean stimulation operations and, more particularly, to processes and apparatus for improving the reliability of pinpoint stimulation operations.

Figure 1:
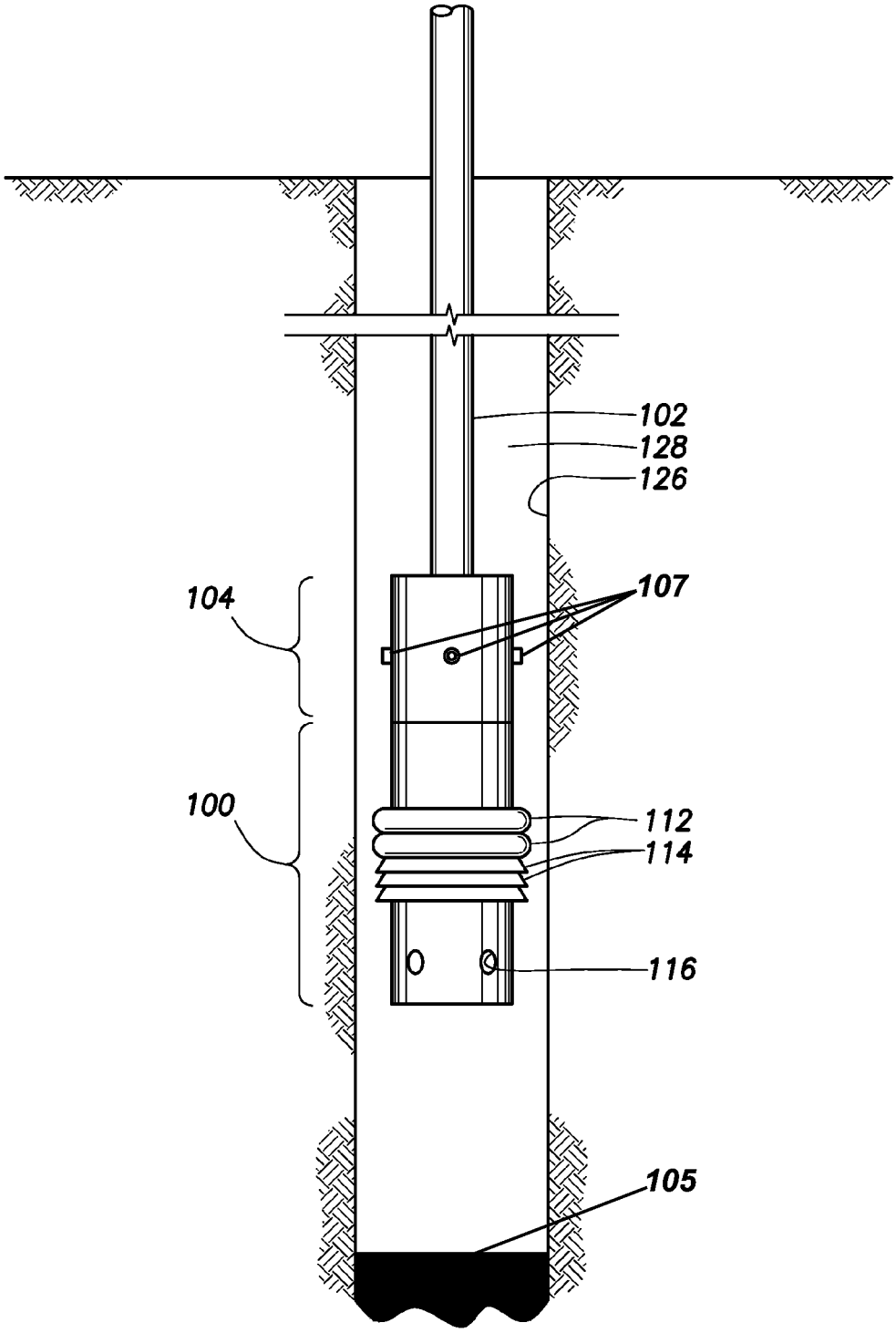
FIG. 1 is a side view of a hydrajet anchor tool connected to a hydrajetting tool in accordance with an exemplary embodiment of the present invention.
Figure 2:
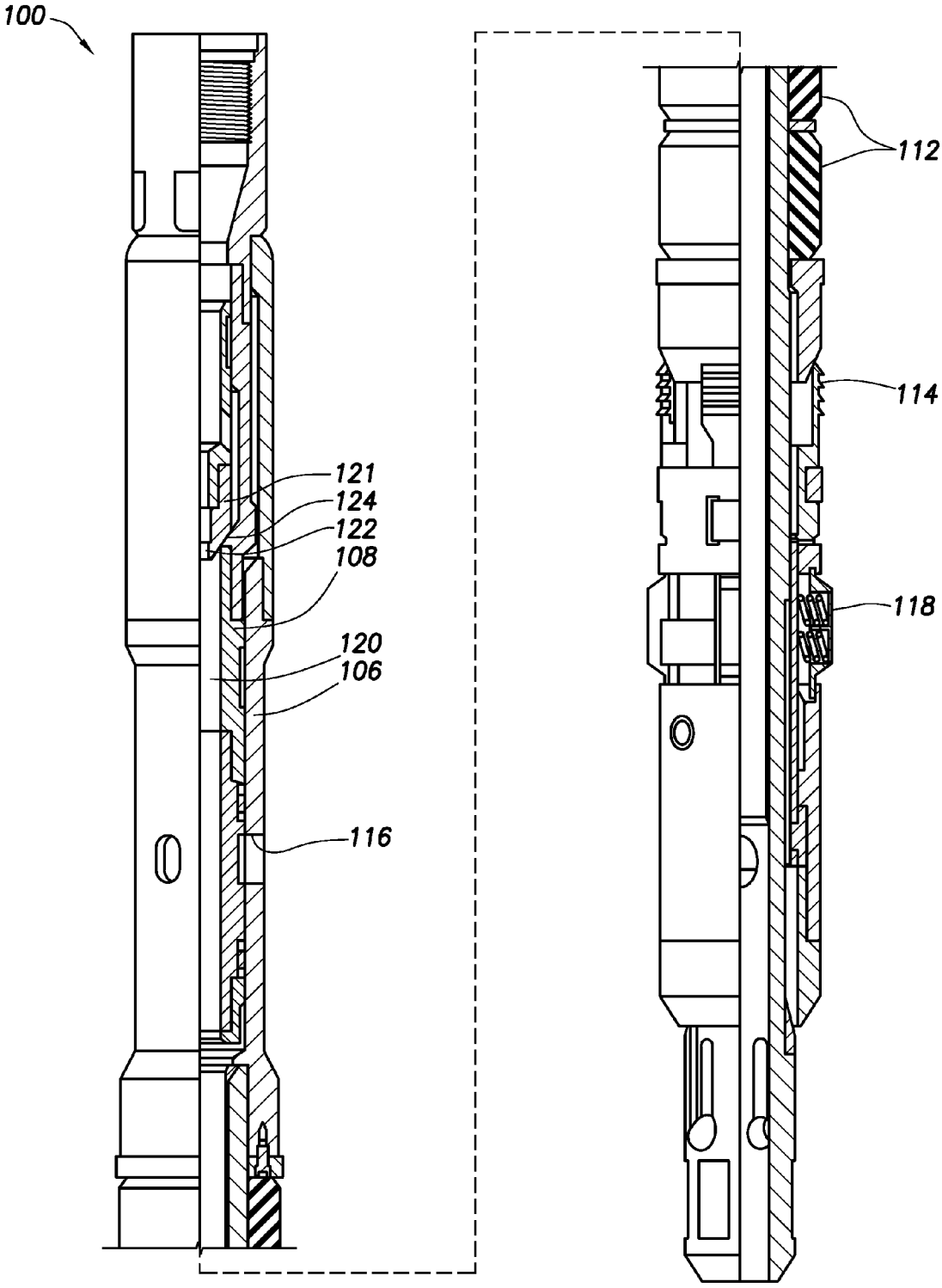
FIG. 2 is a partially cut away side view of a hydrajet anchor tool in accordance with an exemplary embodiment of the present invention.

Referring to FIG. 1, hydrajet anchor tool 100 may be connected to workstring 102 below hydrajetting tool 104, such that fluid from hydrajetting tool 104 may simultaneously pass through jets in hydrajetting tool 104 into a formation and through hydrajetting tool 104 into and through hydrajet anchor tool 100. Referring now to FIG. 2, hydrajet anchor tool 100 may have housing 106, mandrel 108 situated within housing 106, centralizer 112 situated generally around housing 106, anchor 114 situated generally around housing 106, and a one-way restrictor device. Hydrajet anchor tool 100 may also have one or more equalizing ports 116 allowing fluid to flow through housing 106, and/or one or more drag blocks 118.

Housing 106 may have a generally tubular construction, configured to allow fluid to pass therethrough and allow hydrajet anchor tool 100 to cope with hydrajet differential pressures. Housing 106 may include seals between housing 106 and mandrel 108, and be constructed of any material suitable for downhole use, and may connect to hydrajetting tool 104 via threads, welding, or other methods. Mandrel 108 may slide relative to housing 106, allowing for equalizing ports 116 to be selectively opened and closed. Mandrel 108 may also have a generally tubular construction, be constructed of any material suitable for downhole use, and may have passageway 120 to allow fluid to pass therethrough.

Figure 3:
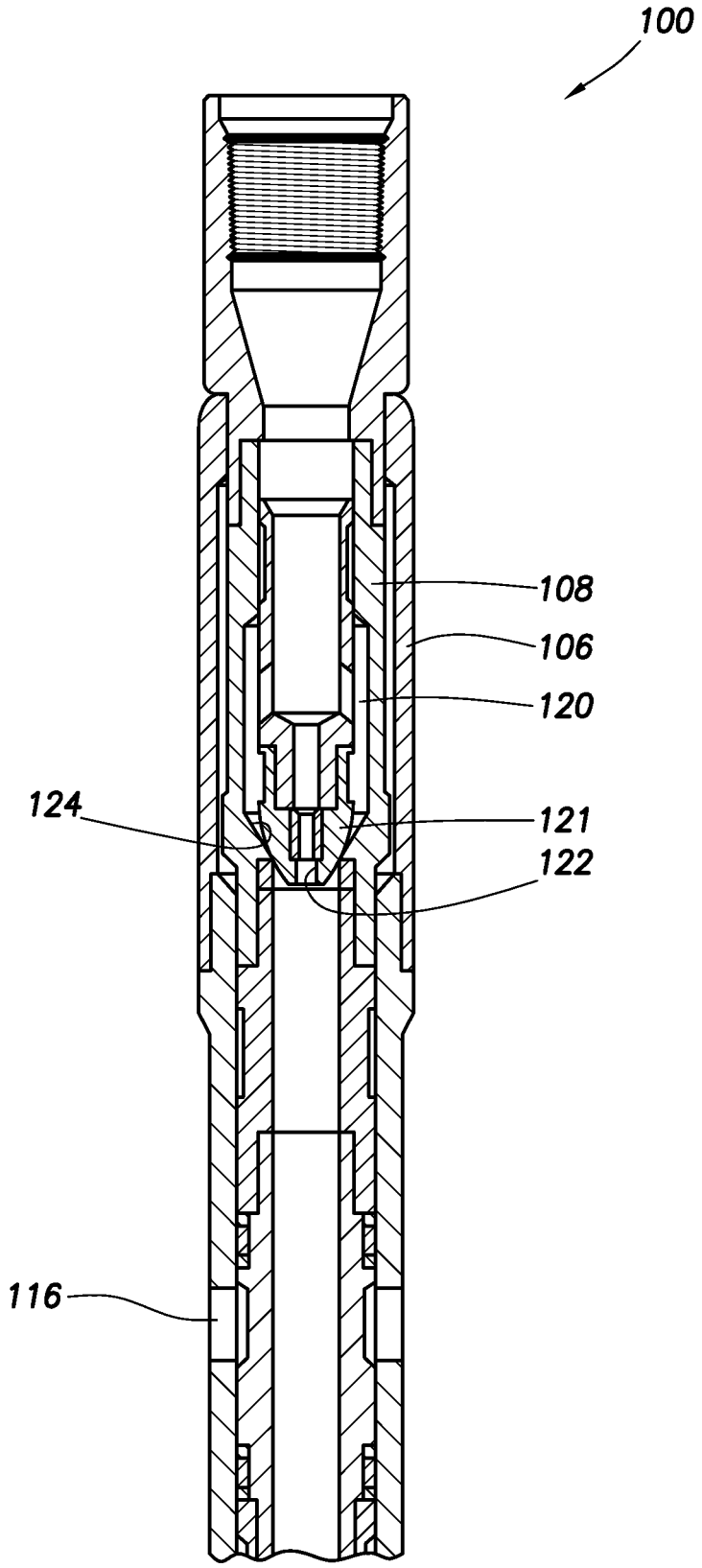
FIG. 3 is a cross-sectional side view of a hydrajet anchor tool in a jet position in accordance with an exemplary embodiment of the present invention.
Figure 4:
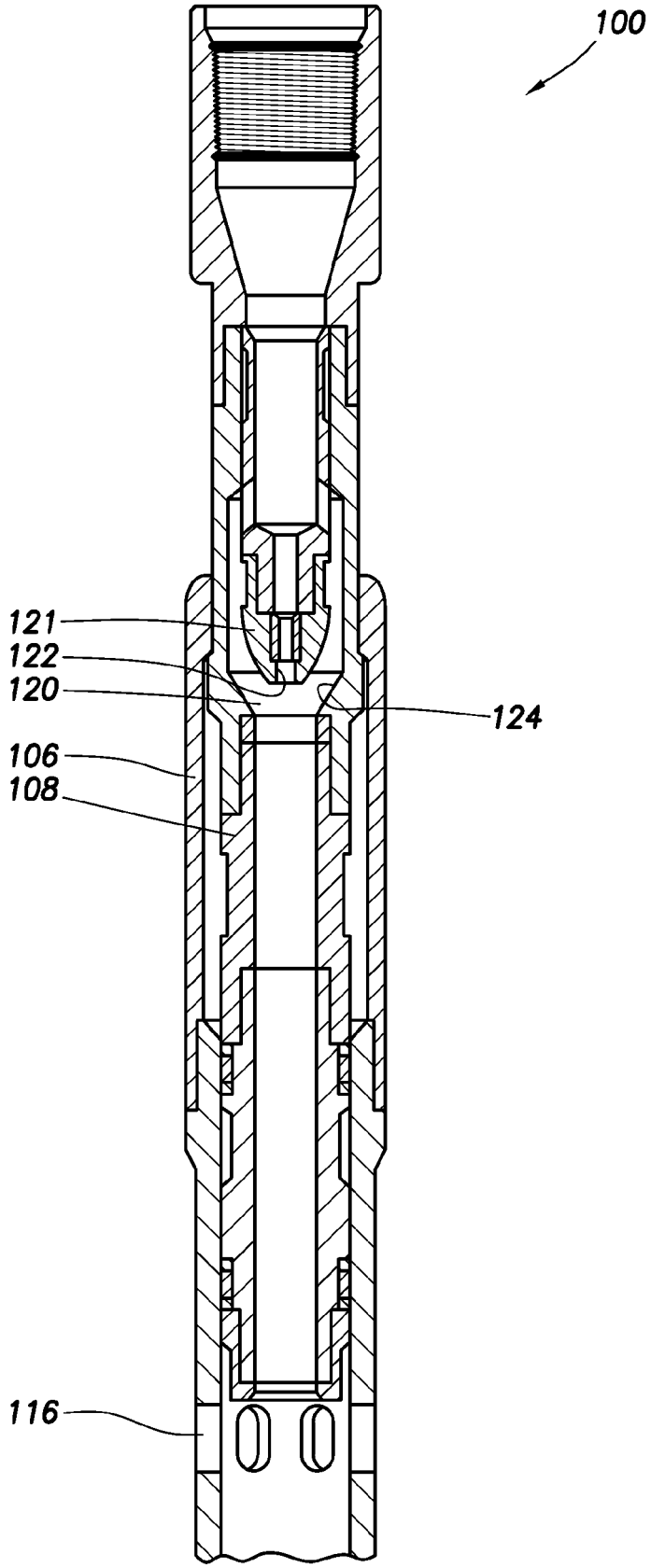
FIG. 4 is a cross-sectional side view of the hydrajet anchor tool of FIG. 3 in a reverse out position in accordance with an exemplary embodiment of the present invention.

The one-way restrictor device may be any device for restricting flow in a first direction while allowing unrestricted flow in a second direction. For example, the one-way restrictor device may include moveable body 121 situated partially, wholly, or otherwise generally within mandrel 108. As illustrated in FIGS. 3 and 4, body 121 may move axially with respect to mandrel 108 to restrict flow through hydrajet anchor tool 100 in one direction yet allow flow in the other direction. In some embodiments the flow in one direction may be unrestricted or free flow. Flow in the first direction may be restricted (but not blocked entirely) by jet 122 (e.g., a port, a regulator, a nozzle, a flow limiting orifice, a simple orifice, a fixed choke, an adjustable choke, and/or any other device allowing pressure to be maintained on one side, while allowing flow therethrough), when body 121 contacts, joins, or otherwise engages seat 124 within mandrel 108. Jet 122 may be configured to cope with high velocity sand laden fluid, while allows fluid to maintain pressure within hydrajetting tool 104, and simultaneously allowing fluid to be used to set a sand plug 105 (FIG. 1) in a zone downhole of hydrajetting tool 104 and hydrajet anchor tool 100. In other embodiments, one-way restrictor device may be a port, a regulator, a nozzle, a flow limiting orifice, a simple orifice, a fixed choke, an adjustable choke, and/or any other device. Generally, one-way restrictor device may be in fluid communication with housing 106, such that the one-way restrictor device may control passage of fluid through housing 106. In some embodiments, the one-way restrictor device may be situated generally within housing 106. In other embodiments, the one-way restrictor device may be on either end of housing 106, or outside housing 106, so long as it restricts flow in a first direction and allows flow in a second direction.

Centralizer 112 may allow for both hydrajetting tool 104 and hydrajet anchor tool 100 to be substantially centered within wellbore 126. Centralizer 112 may maintain hydrajet anchor tool 100 in line with a centerline of wellbore 126, or centralizer 112 may otherwise direct hydrajet anchor tool 100 substantially toward the centerline, such that hydrajet anchor tool 100 does not rest on one side of wellbore 126. In yet other embodiments, centralizer may direct hydrajet anchor tool 100 slightly toward the centerline. In some embodiments, centralizer 112 includes one or more packing elements, such as inflatable packers (which in some instances may be inflatable by one or more process fluids), compression packers, swellable packers, and the like. In some embodiments, the packing elements are elastomeric packing elements. In some embodiments, centralizer 112 may provide a total or partial seal between hydrajet anchor tool 100 and wellbore 126 (which may or may not be cased), while allowing diversion of flow through the one-way restrictor device. Centralizer 112 may be a positive standoff type device, or a variable device. In some embodiments centralizer 112 provides no seal, but rather allows for a gap while preventing hydrajetting tool 104 and the hydrajet anchor tool 100 from resting against wellbore 126.

Anchor 114 may substantially prevent undesirable rotational and axial movement of hydrajetting tool 104 and of hydrajet anchor tool 100, allowing for a more efficient hydrajetting operation. In some embodiments, anchor 114 allows hydrajetting tool 104 and hydrajet anchor tool 100 to be maintained at a fixed position for a desired period. In some instances, this period may cover the duration of hydrajetting operations. For example, anchor 114 may be configured to reduce or prevent rotational and/or axial movement for a period of approximately ten minutes to an hour, or more, if necessary. Anchor 114 may include slips, or other elements to grip wellbore 126, whether cased or uncased. In some embodiments, anchor 114 is downhole from centralizer 112. Anchor 114 may be combined with centralizer 112, such that one or more single stabilizer elements function to centralize and fix hydrajet anchor tool 100 in position. The stabilizer(s) may be affixed to housing 106, either directly or indirectly.

For example, the stabilizer(s) may be generally situated around housing 106, above housing 106, or below housing 106, or the stabilizer(s) may otherwise be situated proximate housing 106, so long as the stabilizer(s) either centralize or fix housing 106 and/or hydrajet anchor tool 100 in position.

In some embodiments, hydrajet anchor tool 100 may be used to improve the performance of hydrajetting tool 104. Specifically, the tool movements due to pipe extension/shrinkage, temperature and/or pressure can be minimized by engaging anchor 114 of hydrajet anchor tool 100. As would be appreciated by those of ordinary skill in the art, with the benefit of this disclosure, the strength requirements for anchor 114 are minimal. For instance, in a vertical well, a 10000 ft. tubing, 2⅜"-4.7 lb./ft. would only need 3800 lbs. to stretch a full 1 ft.; or about 319 lb./in. As would be appreciated by those of ordinary skill in the art, with the benefit of this disclosure, in reality, this value will have to be subtracted by some large unknown value, representing friction with wellbore 126. Note that, even in "vertical" wells, wells are never truly vertical; some slants occur during the drilling of the well. In horizontal wells, movement can sometimes be large due to the "jerkiness" of the system. However, the pipe friction negates some of this movement. For instance, for a 2000 ft. tubing as in the above example, in a horizontal well, assuming a friction factor of 0.35 between the pipe and the well bore wall, the friction force may be close to 3290 lbs, thus needing an additional help of only 500 lbs to prevent the tool's movement. Similarly, the jet reaction force causes some small side movements of the tool. For instance, a 0.25" jet at a pressure of 5000 psi may produce a 400 lb. thrust. Consequently, some small additional force will suffice in preventing the movements of hydrajetting tool 104 during operation. Hydrajet anchor tool 100 may minimize movements of hydrajetting tool 104 and improve the efficiency of the hydrajetting process.

Equalizing ports 116 may allow for equalizing flow through hydrajet anchor tool 100, which may be useful in cleaning or reversal of flow through hydrajet anchor tool 100, or for equalizing below hydrajet anchor tool 100. Equalizing ports 116 may be sized for erosion reduction, or otherwise maximizing flow area without compromising strength. Equalizing ports 116 may be in an open or closed position when running the tools, depending on the particular conditions, and may generally include openings in housing 106. In some embodiments, equalizing ports 116 may align with openings in mandrel 108 to permit selective flow therethrough. As illustrated in FIG. 4, equalizing ports 116 may be aligned with openings in mandrel 108 or otherwise "opened," allowing fluid to enter hydrajet anchor tool, flow up toward body 121. Body 121 may then move upward and away from seat 124, allowing fluid to flow around body 121 and out of hydrajet anchor tool 100 at an upper end. Various configurations for the size and orientation of equalizing ports 116 may be used, depending on the particular application. For example, in some embodiments, equalizing ports may be radially set. In some embodiments, equalizing ports may be radially set at approximately 60°, 90°, 120°, or 180° from one another.

Jet 122 may be at a lower end of body 121 and may be a port, a regulator, a nozzle, a flow limiting orifice, a simple orifice, a fixed choke, an adjustable choke, and/or any other device allowing pressure to be maintained on one side, while allowing restricted flow therethrough. For example, jet 122 may be a 3/16 jet nozzle. Jet 122 may have an internal diameter sized to allow a desired rate of sand laden fluid to flow therethrough, and may be configured to be changed with other jets suitable for particular operations, allowing jet 122 to be optimized for a particular sand plug setting process. Depending on the desired reduction in flow rate, multiple jets may be used in series.

Seat 124 may be a reduced cross-sectional area suitable for engaging body 121. Seat 124 may be sealed within mandrel 108 and have an opening to matingly engage body 121. Seat 124 and body 121 may be configured to seal such that flow through seat 124 is restricted to flow passing through body 121, at least in one direction.

In some embodiments, hydrajet anchor tool 100 may contain a j-slot (not shown) designed to allow the tool to be operated through reciprocating motion. Thus, anchor 114, centralizer 112, or both may be set prior to commencing hydrajetting operations. The j-slot may be on mandrel 108, which may move with workstring 102, and associated lugs may be on a drag spring sleeve (or vice versa).

Hydrajet anchor tool 100 may be run into wellbore 126 beneath hydrajetting tool 104. During run-in, fluid may be pumped through and around hydrajet anchor tool 100 or fluid may be bypassed through hydrajet anchor tool 100. Once a desired location is reached, hydrajet anchor tool 100 may be stabilized by setting anchor 114 and/or centralizer. Setting anchor 114 may anchor, or otherwise reduce or prevent undesirable rotational and axial movement. Likewise, setting centralizer 112 may center hydrajet anchor tool 100 and hydrajetting tool 104 in wellbore 126.

Referring now to FIG. 3, after anchoring and/or centering hydrajet anchor tool 100, hydrajetting may commence via introduction of flow through workstring 102, into hydrajetting tool 104. A first portion of the fluid may flow out of hydrajetting tool 104 through jets, nozzles, or other orifices 107 of hydrajetting tool 104 into the formation to create a cavity in the rock. At the same time, a second portion of the fluid may pass through hydrajetting tool 104 and into hydrajet anchor tool 100 connected thereto. As fluid flows through passageway 120 of hydrajetting tool 104, body 121 may move downward into seat 124, such that a restricted amount of fluid may pass through jet 122 to form a sand plug 105 (FIG. 1) in a previous zone. Hydrajetting tool 104 and hydrajet anchor tool 100 may be moved upward into additional zones, where the process may be repeated. Thus, the various embodiments of the present invention may allow for the performance of an Alpha plug sand setting treatment, while performing hydrajetting operations on the next interval. Likewise, hydrajet anchor tool 100 may enable pumping into the previous zone to reduce total leakoff while hydrajetting the next interval.

Referring now to FIG. 4, once hydrajetting is complete, mandrel 108 may be pulled to expose equalizing ports 116 to passageway 120, allowing for reverse circulation. Fluid may be pumped through equalizing ports 116 and a mule shoe placed at a bottom of hydrajet anchor tool 100. Body 121 may unseat from seat 124 and move upward, allowing fluid to travel both through and around one-way restrictor device, to ensure sufficient flow rate can be achieved to bring sand to the surface. Thus, reverse circulating may expose a larger flow area and allow for higher flow rates, which may assist in removing any plugged sand at or around jet 122. As illustrated, this flow will primarily be around one-way restrictor device, as this path would provide less resistance than through jet 122. Thus, the one-way restrictor device may divert flow to jets in hydrajetting tool 104 when hydrajetting or through larger equalizing ports 116 when reverse circulating.

The embodiments described herein may be useful to improve the efficiency of various pinpoint stimulation processes. For example, hydrajetting processes may be improved by centralizing and controlling movement, COBRAMAX processes may be improved by applying an Alpha plug technique in vertical, deviated, and horizontal wells, and SURGIFRAC processes may be improved by reducing total leakoff.

In some embodiments, having hydrajetting tool 104 placed at an optimum distance from the casing/liner/openhole wall for hydrajetting operations is advantageous or even essential. Conventionally, the efficiency of the jetting process may be adversely affected when the optimum standoff is not achieved, leading to greater jetting times and higher differential pressure for compensation. In addition, the designed number of cavities may not be created in the rock, due to increased standoff, and more damage may occur because of increased effect of splash back because of reduced standoff. Hydrajet anchor tool 100 may thus allow for reduced jetting times, lower differential pressure, and reduced damage.

In some embodiments, hydrajet anchor tool 100 may help reduce movement of hydrajetting tool 104. As described above, movement of hydrajetting tool 104 caused during hydrajetting operations may generally reduce the performance of the process. Conventionally, longer jetting times may be used to create a cavity in the rock. Movement of hydrajetting tool 104 during hydrajetting operations may be caused by pipe extension or shrinkage resulting from temperature and/or pressure, or by tremendous turbulence around hydrajetting tool 104. The movements caused by temperature and/or pressure may be reduced by adopting effective depth control measures and fluid circulation. However, hydrajet anchor tool 100 may provide additional reduction in movement of hydrajetting tool 104. Thus hydrajet anchor tool 100 may provide for reduced operating costs and/or otherwise improve the performance of hydrajetting tool 104 during pinpoint operations.

In other embodiments, hydrajet anchor tool 100 may be advantageous for horizontal wellbores. Conventionally, primary fluid diversion of previous regions in the COBRAMAX technology may be accomplished by placing sand plugs. While this action may be convenient for vertical wellbores, it may not be as straightforward in horizontal wellbores. Placing these plugs in horizontal wellbores may require a very low flow rate, which may be hard to control using surface pumping equipment. Thus, it is desirable to have a system that can produce low flow rates, yet does not plug the orifice. As indicated above, when using high jetting pressures, orifices may be very small to create a low flow rate, which may make the orifices very susceptible to plugging. Jet 122 may be used to reduce the flow rate, for example to one barrel per minute (bpm) or lower, without using extra small chokes that would tend to plug when exposed to sand. Depending on the desired reduction in flow rate, multiple jets may be used in series to prevent plugging. Therefore, hydrajet anchor tool 100 may allow for the placement of competent sand plugs at desired locations. Jet 122 in accordance with an exemplary embodiment of the present invention may be designed to accept 8 Mesh or even larger particles. Thus, use of hydrajet anchor tool 100 may allow for a reduced time to set sand plugs and/or otherwise improve the capability for creating sand plugs in COBRAMAX operations, especially for horizontal well applications.

In other exemplary embodiments, the present invention may be used in conjunction with SURGIFRAC operations. As indicated above, SURGIFRAC uses the Bernoulli principle to achieve fluid diversion between fractures. Specifically, once a first fracture is created during the SURGIFRAC operations, hydrajetting tool 104 is moved to a second location to create a second fracture. The primary flow goes to the fracture while leakoff flow is supplied by the annulus, and this is generally considered a "secondary" flow. However, some of the fluids that are being pumped into the annulus will leakoff into the already existing fracture. In long horizontals, many fractures may be desirable. However, each fracture causes additional leakoff and the annulus flow quickly becomes the "primary" flow. Centralizer 112 of hydrajet anchor tool 100 may reduce the amount of leak off fluid flow through the annulus from hydrajetting tool 104 to the existing fractures. Specifically, centralizer 112 may restrict the path of the leak of fluid flow, thereby reducing the amount of fluids leaked off. Consequently, hydrajet anchor tool 100 may reduce the annulus flow requirement while maintaining pore-pressure and limited flow influx to let the fracture slowly close without producing sands back into wellbore 126 after fluid injection has stopped. Hydrajet anchor tool 100 may also reduce or eliminate the need to pump harder and harder for each subsequent stage, thus reducing fluid losses and saving expense on fluids and/or otherwise improve SURGIFRAC performance in long horizontals. Finally, hydrajet anchor tool 100 may be designed to mitigate the effects of internal erosion.

As would be appreciated by those of ordinary skill in the art, with the benefit of this disclosure, the term "pinpoint stimulation" is not limited to a particular dimension. For instance, depending on the zones to be isolated, the area subject to the "pinpoint stimulation" may be a few inches or in the order of tens of feet in size. Moreover, although the present invention is disclosed in the context of "stimulation" processes, as would be appreciated by those of ordinary skill in the art, the apparatuses and methods disclosed herein may be used in conjunction with other operations. For instance, the apparatuses and methods disclosed herein may be used for non-stimulation processes such as cementing; in particular squeeze cementing or other squeeze applications of chemicals, fluids, or foams.

As would be appreciated by those of ordinary skill in the art, although the present invention is described in conjunction with hydrajetting tool 104, it may be utilized with any stimulation or other jetting tool where it would be desirable to minimize tool movement and/or fluid leak off (e.g., a port, a valve, a window, and the like). Moreover, as would be appreciated by those of ordinary skill in the art, with the benefit of this disclosure, any references to the term "sand" may include not only quartz sand, but also other proppant agents and granular solids, such as beads, slivers, clays, chemical particulates, gels, and other materials. Further, while a sand plug is disclosed, other barriers may be used to isolate the formation and/or divert flow, including any of a number of isolation fluids and/or materials. Additionally, as would be appreciated by those of ordinary skill in the art, with the benefit of this disclosure, although the present invention is described as using one hydrajet anchor tool, two or more hydrajet anchor tools may be used simultaneously or sequentially in the same application to obtain desired results, without departing from the scope of the present invention.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. An anchor tool comprising:

a housing having a mandrel movably arranged therein;

a one-way restrictor device in fluid communication with the housing and movably arranged within the mandrel between a first position, wherein the one-way restrictor device is matingly engaged with a seat defined on the mandrel, allows restricted fluid flow through the housing in a first direction, and a second position, wherein the one-way restrictor device is separated from the seat, allows fluid flow in a second direction that is opposite the first direction; and a stabilizer affixed to the housing.

2. The anchor tool of claim 1, wherein the one-way restrictor device comprises a body that has at least one jet arranged therein and configured to restrict the fluid flow through the one-way restrictor device in the first direction.

3. The anchor tool of claim 1, wherein the stabilizer comprises an anchor configured to substantially prevent at least one of rotational movement and axial movement of the anchor tool.

4. The anchor tool of claim 3, wherein the anchor comprises one or more slips.

5. The anchor tool of claim 1, wherein the stabilizer comprises a centralizer configured to substantially center the anchor tool within a wellbore.

6. The anchor tool of claim 5, wherein the centralizer comprises at least one elastomeric packing element.

7. The anchor tool of claim 1, wherein the stabilizer comprises a centralizer and an anchor.

8. The anchor tool of claim 1, wherein the housing defines one or more equalizing ports configured to align with a corresponding one or more openings in the mandrel to permit flow therethrough.

9. A method of diverting flow comprising:

pumping a fluid through a stimulation tool;

passing at least a portion of the fluid from the stimulation tool to an anchor tool communicably coupled thereto, the anchor tool including a housing having a mandrel movably arranged therein and a one-way restrictor device movably arranged within the mandrel;

moving the one-way restrictor device to a first position within the mandrel where the one-way restrictor device allows restricted fluid flow through the housing in a first direction;

introducing the fluid from the anchor tool to set a sand plug at a desired location; and diverting flow at the desired location with the sand plug.

10. The method of claim 9, comprising anchoring the anchor tool prior to pumping the fluid through the anchor tool.

11. The method of claim 9, comprising centering the anchor tool prior to pumping the fluid through the anchor tool.

12. The method of claim 9, wherein the one-way restrictor device comprises a body and at least one jet arranged within the body, the method further comprising directing the fluid flow through the at least one jet, thereby restricting the fluid flow through the one-way restrictor device in the first direction.

13. The method of claim 12, wherein moving the one-way restrictor device to the first position comprises matingly engaging the body with a seat defined on the mandrel.

14. The method of claim 13, further comprising moving the one-way restrictor device to a second position within the mandrel where the one-way restrictor device allows fluid flow in a second direction within the housing that is opposite the first direction.

15. The method of claim 14, wherein moving the one-way restrictor device to the second position comprises:

moving the mandrel within the housing to expose one or more equalizing ports defined in the housing;

allowing an influx of recirculation fluid through the one or more equalizing ports and into the mandrel;

disengaging the body from the seat with the influx of the recirculation fluid; and flowing the recirculation fluid around the one-way restrictor device and out of the anchor tool.

16. A method of improving the performance of a stimulation tool comprising:

stabilizing within a wellbore an anchor tool connected to the stimulation tool, the anchor tool including a housing having a mandrel movably arranged therein and a one-way restrictor device movably arranged within the mandrel;

introducing a fluid into the stimulation tool;

passing a first portion of the fluid out of the stimulation tool via one or more jets or nozzles and into a formation;

passing a second portion of the fluid through the stimulation tool to the anchor tool; and moving the one-way restrictor device to a first position within the mandrel where the one-way restrictor device allows restricted fluid flow through the housing in a first direction.

17. The method of claim 16, wherein stabilizing the anchor tool is performed prior to introducing the fluid into the stimulation tool.

18. The method of claim 17, wherein stabilizing within the wellbore the anchor tool comprises setting an anchor and a centralizer prior to introducing the fluid into the stimulation tool.

19. A hydrajetting bottomhole assembly comprising:

a hydrajetting tool; and a hydrajet anchor tool connected to the hydrajetting tool, the hydrajet anchor tool comprising, a housing having a mandrel movably arranged therein;

a one-way restrictor device in fluid communication with the housing and movably arranged within the mandrel between a first position, wherein the one-way restrictor device is matingly engaged with a seat defined on the mandrel, allows restricted fluid flow through the housing in a first direction, and a second position, wherein the one-way restrictor device is separated from the seat, allows fluid flow in a second direction that is opposite the first direction; and a stabilizer affixed to the housing.

* * * * *